United States Patent [19]

Ellen

[11] 4,408,517

[45] Oct. 11, 1983

[54] PIPE ORGAN

[76] Inventor: Leonard W. Ellen, "Briarmead", Chiltern Rd., Ballinger, Great Missenden, Buckinghamshire, England

[21] Appl. No.: 182,211

[22] Filed: Aug. 28, 1980

[51] Int. Cl.[3] ..... G10B 3/10

[52] U.S. Cl. ..... 84/345; 84/341; 84/1.19

[58] Field of Search ..... 84/345, 1.19, 1.01, 84/115, 1.03, 341

[56] References Cited

U.S. PATENT DOCUMENTS

| | | | |
|---|---|---|---|
| 3,926,087 | 12/1975 | Griffis | 84/345 |
| 4,157,049 | 6/1979 | Watanabe | 84/345 |
| 4,178,828 | 12/1979 | Henschen | 84/345 |

*Primary Examiner*—B. Dobeck
*Assistant Examiner*—Forester W. Isen
*Attorney, Agent, or Firm*—Wolf, Greenfield & Sacks

[57] ABSTRACT

A pipe organ in which information relevant to actuation of keys and stops at a console of the organ is stored in random access memory, and the specifications for stops are held in pre-programmed read only memory, the requirements for each pipe being examined in turn by scanning means.

8 Claims, 4 Drawing Figures

CLOCK
47
PIPE
PIPE LATCH
56
55
54
PIPE RANK
43
FROM RANK COUNTER DEMULTIPLEXER
MASTER LATCH
60
42
FROM ROM 37
46
FROM LATCH 41

PIPE ORGAN

The invention relates to a pipe organ having electronic means which correlate the notes, stops and couplers of the organ. The organ may use known means of transmitting time-division multiplex (TDM) signals from a console of the organ to electromagnets which control the organ pipes, or may make use of conventional transmission of signals from the console by means of multi-wire cables, or may use a combination of these two systems.

It is a basic requirement of the mechanism of a pipe organ that it must permit the sounding of any pipe from one or more of several different notes of the several keyboards commonly provided. There are usually at least two, and frequently more, manually-operated keyboards of, usually, 61 notes and a pedal board of, usually, 32 notes. The pipes are arranged in ranks, each rank containing a number of pipes of different musical pitch but of similar musical timbre. For example, a flute rank may contain 97 pipes covering a range of eight octaves and producing flute-like sounds. As any rank may have more pipes than the keyboards have notes, and for certain musical effects, it is necessary to arrange that each note of the keyboard can, at the organist's discretion, control several-pipes of different pitch and timbre.

In musical terminology the relation between the various pitches required to be sounded from any one keyboard is by octaves, fifth and thirds, the logical equivalents of which are respectively twelve, seven and four semitones differences of pipe pitch. Multiple octaves are also required. The discrepancy between the two terminologies arises from the musicians' concern only with the notes of the diatonic scales which omit certain semitone intervals.

Connection of the ranks of pipes to the keyboards at the desired pitches is under the control of switches known as "stop-keys", "drawstops", "tabswitches" or commonly abbreviated to "stops". In the past, each stop controlled an electromagnetic or electropneumatic relay which operated up to 61 pairs of contacts. More recently, these relays have been replaced by an equivalent plurality of electronic solid-state devices.

It is already known to transmit information from the keyboards and stop-keys of an organ console to the pipe chambers by means of a TDM system and my British patent specification No. 1516646 describes and claims a pipe organ comprising a pipe sounding section having a rank of pipes for sounding musical notes, a note playing section having a plurality of playing keys allocated to individual notes and operable by a player of the organ, and a plurality of stops operable by the player of the organ for selecting desired correlations between keys played and pipes to be sounded, one of said stops selecting a given basic pitch relationship desired between the keyboard and the pipes, others of said stops selecting other pitch relationships desired between the keyboard and the pipes, said organ comprising time-division multiplex means for cyclically electrically sensing the operative conditions of the stops and keys and providing multiplex signals representative of the operative condition of the organ at any time, means for transmitting the signals to the pipe sounding section of the organ, store means allocated to the individual stops, means for operating the store means from said signals to cause said store means to store sensed operative conditions of the stops, means for modifying the signals, said modifying means being means which are operable during each time-division multiplex slot that a key operative condition is being sensed and which modify the signal in said time slot a number of times equal to the number of said pitch relationships whereby said modified signal successively represents the address of a pipe having said basic pitch relationship to the playing key being sensed, and the addresses of pipes having said other pitch relationships to the playing key being sensed, means for de-multiplexing the modified signals and means for controlling individual pipes in response to the signals from the demultiplexing means, in accordance with the sensed operative conditions of the keys, there being gate means for each desired pitch relationship, each said gate means having a plurality of inputs, there being means activating one said input in accordance with the playing key being sensed having been depressed, means activating another of said inputs from the store means allocated to a stop selecting the pitch relationship to which said gate means is allocated and means activating another of said inputs during the time period when the modifying means is effecting a modification of said signal appropriate to the pitch relationshp to which said gate means is allocated, each said gate means having an output for enabling operation of said pipes by said pipe controlling means when all inputs of a given gate means are simultaneously activated.

The system described in the said specification requires the use of a double latch to control each pipe and requires custom-built wiring to define the function of each stop.

I have now discovered that it is possible to use a single latch for each pipe instead of a double latch with a consequent substantial reduction of cost. Furthermore, it is possible to determine the functions of each stop-key by programmable electronic memories, thus enabling the wiring to be simplified and standardised to a large extent, with consequent economy in production, while allowing alterations to be made easily to meet the requirements of individual customers.

The invention consists in a pipe organ comprising a pipe sounding section having ranks of pipes for sounding musical notes, a note playing section having a plurality of playing keys allocated to individual notes and operable by a player of the organ, and a plurality of stops operable by the player of the organ for selecting desired correlations between keys played and pipes to be sounded, said stops selecting various pitch relationships desired between the keyboard or keyboards and the pipes, said organ comprising means for transmitting electric signals providing information relative to the operative conditions of the stops and keys to a receiving section, the receiving section comprising binary logic means arranged for addressing pipes and ranks in a predetermined sequence and arranged for examining the said transmitted signals, or examining stores in which the said transmitted signals are held in the receiving section, whereby to derive pipe and rank enable signals if for the particular pipe or rank address the said operative conditions of the stops and keys require the pipe or pipes to be sounded, the receiving section having a programmed read-only-memory holding specifications for the coupling between ranks and/or sections of ranks to be effected to meet the requirements of given stops.

It will be appreciated that the hitherto necessary custom-wiring of the relationship between stops, pipe ranks, keyboards and pitches, required in the organ of my British patent specification No. 1516646 is avoided by use of the ROM storage of the specifications, and that a double latch system for each pipe is unnecessary.

In addition to the flexibility of control provided by means of the stops it is usual to provide facilitates in a pipe organ which enable the functions of the organ keyboards to be interchanged or coupled and which enable notes of some or all of the keyboards to have the effect of playing other notes an octave higher or lower than their normal pitch, such change of pitch being also combined with the interchange or coupling of keyboards when so desired. The ranks of a pipe organ are usually divided into "Departments" designated as "Great", "Swell", "Choir", "Solo", "Pedal" and so on. Each Department is normally played from a particular keyboard which in this description is referred to as the "home" keyboard; disconnection from the home keyboard and/or connection to foreign keyboards is a function of the couplers.

An embodiment of this invention provides facilities for achieving the functions of the couplers in a manner similar to that proposed for achieving the stops functions. These additional facilities may be provided in association with the stops functions at the receiving end of the system, that is at the pipe chambers, but when transmission from the console is by means of a TDM system it is preferred to effect the keyboard coupling at the console.

It is known that in an electrical control system for a pipe organ a response time of some 30–40 milliseconds (mS) is sufficiently fast. Faster response can easily be provided, whether transmission is by multi-wire cable or TDM, and it is therefore permissible to add, say, 5 mS to the response time, for the purpose of additional data processing, without introducing unacceptable degradation. As the normal maximum number of pipes in a rank is 97 it is permissible to allocate at least 50 microseconds ($\mu$S) for the processing of the data relevant to each pipe, provided that corresponding pipes of all ranks are dealt with at the same time.

Digital integrated circuits capable of functioning at speeds of the order of ten million operations per second are readily available, and it is therefore feasible to effect some 500 discrete operations within the period of 50 $\mu$S which can be allotted to each pipe. An average-size pipe organ has some 50 stops and the number rarely exceeds 100. It is therefore easily possible to examine the correlation between every stop separately and the relevant notes of the keyboards for each of 97 pipes of different pitch within a period of about 5 mS; moreover the range can if necessary be extended to the electronically-convenient number of 128 pipes, which represents a rank which more than spans the range of human auditory sensibility.

To effect the desired correlation it is essential that data relating to the on/off state of each and every note and stop shall be available at very short notice in non-sequential order and when those data are supplied sequentially by a TDM transmission system it is necessary to record and repeatedly up-date the transmitted information in a random-access read-write electronic memory (RAM). When transmission is by multiwire cable, immediate access is easily available via a simple multiplexing system provided for that purpose.

In practice the maximum number of different pitches at which stops are provided is 16, and the number of keyboards is seldom more than 4 and never more than 8. It is therefore possible to specify the required pitch of a stop in four binary digits and the required keyboard in 2 or 3 binary digits. The number of ranks is theoretically unlimited but in practice is limited by cost and rarely exceeds 32 and each rank can therefore be specified in a maximum of 5 binary digits. Thus a total of 12 binary digits suffices in practice to define the complete function of a stop. Commercially-available programmable read-only memories (PROM) commonly deliver data in 'bytes' of 8 bits, and $1\frac{1}{2}$ bytes are therefore needed for each stop. Typical of a small PROM is the SN74188A integrated circuit which holds 32 bytes of 8 bits. Three such integrated circuits will provide the necessary PROM capacity for 64 stops. Larger PROMs or combinations of small ones will provide capacity for any number of stops up to the maximum for which sufficient speed of operation is available; beyond that limit, two or more systems may be operated in parallel.

The number of stops provided in practice is usually only a small proportion of the number theoretically possible. For example, a 5-keyboard organ of 16 ranks with stops for all possible combinations of pitch, rank and keyboard would have 1280 stops, but in practice would probably have between 50 and 100 stops. The use of PROMs to specify stop functions enables the customer to choose which of the 1280 possibilities shall be provided. Supplementing of the PROM capacity by read-write memories (RAMs) and the addition of 'writing' facilities will enable the organist to add specially chosen stops on a temporary basis.

Circuitry for interkeyboard couplers and octave and suboctave couplers is most conveniently provided at the organ console. Allowing for coupling at unison, octave and suboctave pitches, the number of couplers theoretically possible is three times the square of the number of keyboards; for example, an organ with 5 manuals and a pedal keyboard could have 108 such couplers, but in practice the number actually provided would be much smaller. Commonly the number would be from 3 to 10, and would rarely exceed 30.

Three items of information are required to specify the function of a keyboard coupler; the addresses of the keyboards to be coupled, and the pitch at which they are to be coupled. As there are never more than eight keyboards, three bits suffice for each address and a further two bits will specify up to four coupling pitches, making 8 bits in all. Thus, one small PROM such as a SN74188A integrated circuit can contain the specifications for the maximum number of couplers likely to be needed.

In the following description reference is made to the wellknown SN74 . . . series of integrated-circuit TTL devices, but it is to be understood that other digital devices performing similar functions may be used, for example microprocessors.

If the transmission of data from the console to the pipe chambers is by means of a TDM system, the incoming data perform no immediate operation on the pipe magnets but instead are written into a random-access memory (RAM) such as the SN74200 integrated circuit, sufficient memory capacity being provided to accommodate a record of all the transmitted channels. It is convenient, but not essential, to record data relevant to the notes of the keyboards and data relevant to the stops in separate memory devices so that the contents of the two memories can be read-out simultaneously and immediately combined in a two-way gate to determine whether both note and stop are on and thus determine whether a given pipe is required to sound. If for the sake of economy in small instruments it is desired to use a single memory, the two items can be read sequentially, the result of reading the first being stored temporarily in a simple latch in readiness for correlation with the second.

If transmission from the console is by multi-wire cable, the RAM is replaced by a simple multiplex system permitting random access to the incoming wires.

Each pipe is provided with a single latch circuit of the type in which data is transferred from an input terminal to an output terminal when a 'clock' or 'enable' signal is applied to a relevant controlling input terminal. Upon cessation of the clock signal the output remains set and is independent of subsequent changes of the input data until the latch is again clocked. An example of such a device is the SN7475 integrated circuit which includes four such latches in a single package.

All the input data terminals of the latches for any one rank of pipes are commoned to form a data input line for that rank. The clock terminals for pipes of corresponding pitch of all ranks are commoned, forming an array of, typically, 97 clock lines each of which clocks all the pipe circuits of a given pitch. A de-multiplexing system consisting of, typically, a combination of SN74154 and SN74155 integrated circuit devices serve to connect the clock lines one at a time to a master clocking line. As a matter of practical convenience the amount of inter-board wiring may be reduced by providing the final stage of de-multiplexing separately for each rank, or for each two ranks.

The de-multiplexing system is addressed by means of a binary counter for seven binary stages, thus providing for a maximum of 128 pipes for each rank. The counter is driven at a rate sufficient to give access to all pipes in a time short enough not to impair response of the organ noticably but long enough to allow examination of all the stops during the period of dwell on each pipe. If TDM transmission from the console is used, it will usually be possible to use the TDM counter for this additional purpose and in some cases it may be possible to use a common de-multiplexer, at least in part.

During the dwell on each pipe, another counter driven at a rate sufficient to cover all the stops within one dwell period, that is to say, typically at about 2MHz, selects in sequence the bytes of data held in PROMs relevant to the requirements of all the stops in sequence. The addressing system for the PROMs is arranged to correspond with the RAM addresses in which the current state of the corresponding stop-keys at the console are recorded. As already described, the number of bits required to specify a stop function will depend upon the size of the organ and will be taken as typically 12 bits, equivalent to $1\frac{1}{2}$ bytes.

As each stop is examined and the 12 bits are read out from the PROMs several operations occur almost simultaneously:

(a) The read-write memory containing the record of the current state of the stop is interrogated.

(b) The address of the pipes as shown by the current state of the pipes de-multiplexer is fed to one set of inputs of an adder, for example two SN7483 integrated circuits, a 7-bit adder being required to deal with up to 128 pipe addresses. Four binary digits from the PROM defining the required pitch are decoded by means of a further PROM or by means of an array of gates to form a 7-bit number equivalent to the number of semitones difference between pipe pitch and relevant note pitch and this binary number is fed to the other set of adder inputs. The resultant output of the adder defines the address within a keyboard of the one note which will sound the pipes of any rank at the pipe and stop addresses currently under examination. As the keyboards always have less than 63 notes, six bits will select the relevant note, the seventh bit being needed to indicate an overflow condition due to certain pipe/note combinations being beyond the range of the keyboards.

(c) Two, or three, further bits from the PROM define which "home" keyboard is to be selected as relevant to the stop. These bits together with the adder outputs are used to address the RAM containing the record of the keyboard notes and the RAM is interrogated at this address.

(d) The rank-address bits from the PROM are decoded to open a gate to a latch serving the specified rank.

(e) If the results of the interrogations in paragraphs (a) and (c) are both affirmative, showing that both the stop and the relevant note are 'on', a pulse is delivered to the latch specified in paragraph (d), thus setting the latch to the 'on' state.

The operation described in paragraph (e) is under the control of a strobing pulse which ensures that a stable state has been reached for the operations described in paragraphs (a) to (d) before action is taken.

These operations are effected in, typically, $\frac{1}{2}$ $\mu$S after which the binary counter proceeds to the next stop address. This continues until all stops have been processed in relation to one pipe address. In general, a pipe can be turned on by one or more of several note/stop combinations, and is to be turned off only if none of those combinations call for it to be 'on'. On completion of the sequence covering all the stops, the rank latches will have been set for those ranks for which a combination of 'stop on' and relevant "note on' has been found for at least one stop. Other rank latches will have remained off. As the whole sequence will have been completed during the dwell on one pipe address, the relevant pipes in the several ranks will still be addressed by the pipe multiplexer. The outputs of the rank latches supply the data lines for the pipe latches, and an enable, or 'clock', pulse is fed to the pipe de-multiplexer and sets the latches of the relevant pipes to either the on state or the off state, as appropriate.

The rank latches are then reset to the off state in readiness for the next pipes, and the pipe de-multiplexer steps to the next pipe address. The process is then repeated, thus up-dating the setting of all pipe latches within a period of some 5 milliseconds.

Detail modifications of the procedure are possible. The use of a secondary PROM to convert the four-bit pitch code to the appropriate adder input may be avoided by adopting a five-bit pitch code within the PROM. The required addition is never more than 61 and six bits are clearly sufficient, and due to the fortunate circumstance that for the practical pitches needed, two of the bits always correspond, one bit can serve for two. Thus, in fact 5 bits suffice.

In the form of the invention as described above, there is complete freedom of allocation of the three stop functions, namely selection of pitch, keyboard, and rank, to any stop, and there is no restriction on the order in which stops are allocated. Subject to the loss of part of this freedom, some economy of memory capacity can be effected by taking one of the three functions in a pre-arranged sequence instead of at random, preferably the function of rank selection. It is then possible to deal with any number of ranks with only one byte of PROM capacity per stop, instead of 1½ bytes. When this preferable procedure is used, stops may be allocated on the basis of a fixed number per rank or, preferably, one bit of the 8-bit PROM output is used as a marker to show when the last stop relevant to a particular rank has been reached. The individual rank latches are replaced by a single master latch and the data lines to each individual rank are replaced by a single common data line. Control of individual ranks is retained by the provision of a separate enable line to each rank, the relevant enable line being pulsed when all the stops of a given rank have been dealt with. Selection of the appropriate enable line is by means of a simple de-multiplexer driven by a rank counter which is stepped forward by the 'last-stop' marker and is reset to zero when the pipe counter steps forward.

Interkeyboard coupling and keyboard pitch coupling are effected by the use of PROMs and adders in a manner similar to that already described for stop/note correlation. Such couplings are interposed between the keyboards and the stop/note correlation system, and when a TDM system is used for transmission from the console to the pipes, interkeyboard coupling and keyboard pitch coupling is conveniently provided by circuitry at the console. A counter operating at, typically, 32 times the bit-rate of the TDM system drives the address inputs of a PROM such as SN74188A integrated circuit, giving an output byte of 8 bits for each of 32 addresses. Three of the eight bits are used to define the keyboard from which coupling is to take place and a further three bits define the keyboard to which coupling is to be made. The remaining two bits define the relative pitch of the coupling. The first three bits are compared with that part of the current address in the TDM system which defines the address of the home keyboard, or organ Department, currently under examination, and the coupling circuitry is temporarily disabled if these do not correspond. The next three bits from the PROM cause the TDM multiplexer to select the keyboard to which coupling is to be made. The remaining two bits from the PROM are decoded to provide one set of inputs to an adder so that the address of the individual note addressed by the TDM system is decreased by 12, left unaltered, or increased by 12, according to whether the desired coupling is to be at octave, unison, or sub-octave pitch. The other set of inputs for the adder is supplied by the counter controlling the TDM system, and the outputs of the adder supply the required address to the multiplex system to interrogate the relevant keyboard note. If the result of the interrogation is affirmative and the relevant coupler switch is on, then a latch is set. The procedure is repeated for each coupler, and when all couplers have been dealt with the latch will have been set if any one or more of the couplers, correlated with the relevant notes, have shown that an 'on' signal is to be transmitted. Depending upon the method of modulation adopted for the TDM transmission system it may be necessary to carry out the coupler/note correlation one step in advance of the TDM transmission, and it may therefore be necessary to transfer the result of that correlation to a temporary store to control the TDM transmission while the next sequence of coupler correlation is taking place. The latch is then reset.

Coupling at any pitch can be effected, but normally only octaves and multiples thereof are needed.

When transmission from console to pipe chamber is by multi-wire cable the coupler system described herein may be located in the pipe chamber. A multiplexing system substantially as would be required for a TDM transmission system is provided so that data are presented to the coupler system in serial form. The output of this system is effectively the output of a TDM system and the stop/note correlation system which follows it will need to include random access memories as already described for the purpose of correlating stops and notes after a TDM transmission system.

The PROM referred to in the foregoing description of the coupler system may be supplemented by, or replaced by, a read-write memory thus affording the facility of alteration at will by the organist.

In order to make the invention clearly understood, reference will now be made to the accompanying drawings which are given by way of example and in which.

Figure 3:
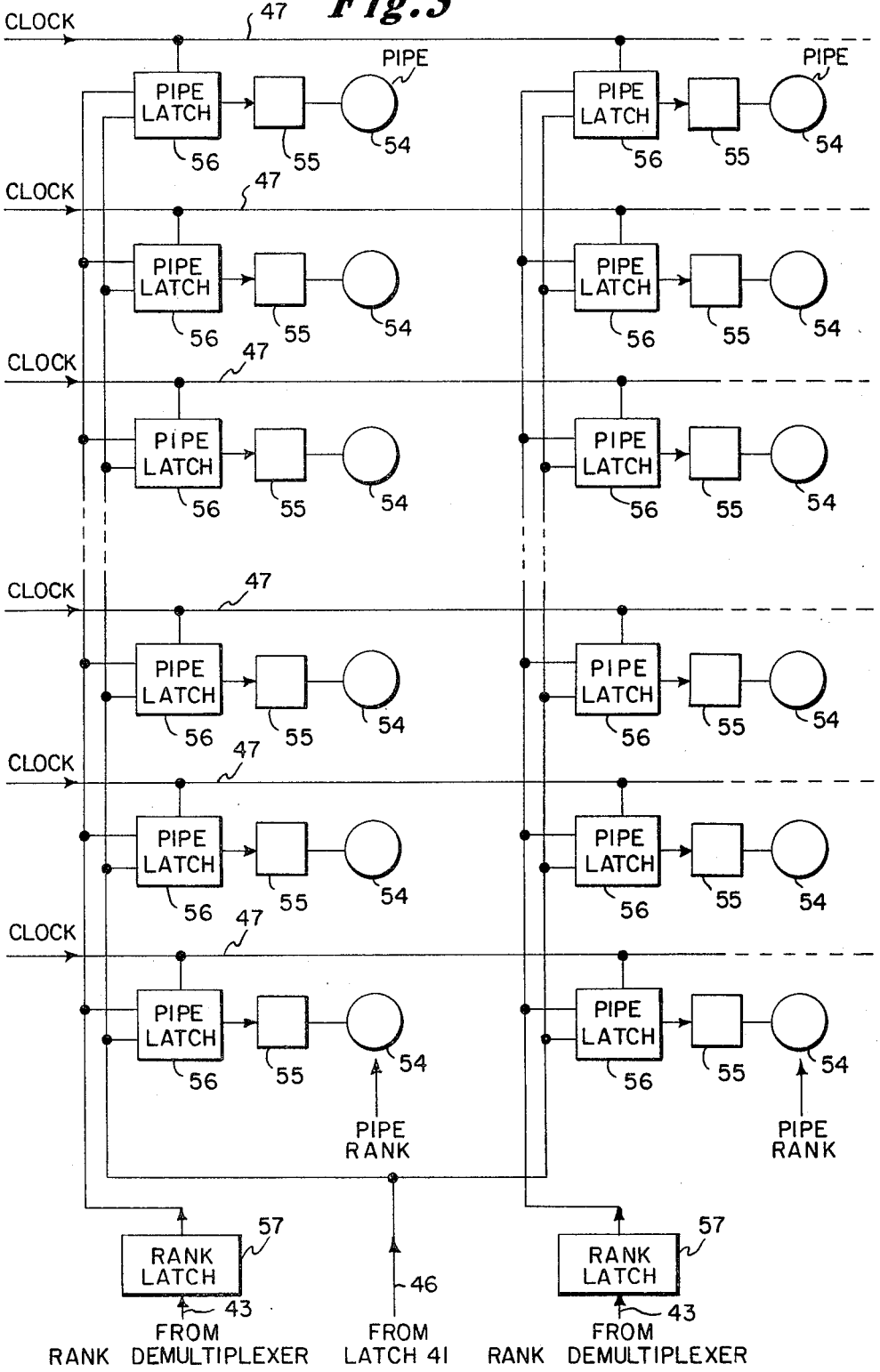
Figure 4:
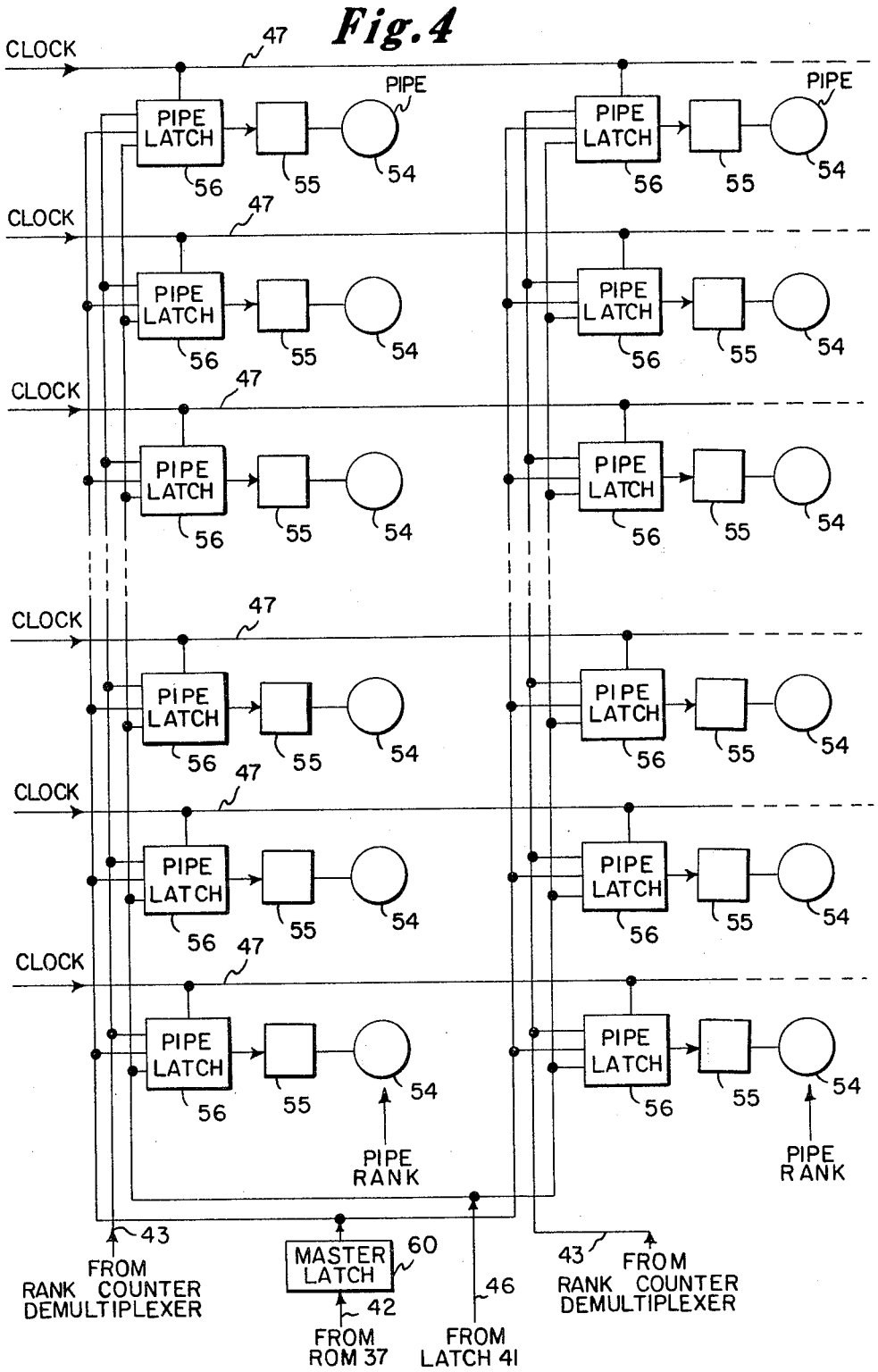

FIG. 3 schematically shows the arrangement of pipe latches and rank latches in an embodiment of the invention; and FIG. 4 depicts the scheme of an arrangement in another embodiment of the invention in which a master latch is used for all pipe ranks instead of providing each rank of pipes with its own rank latch.

The following description is given on the assumption that the reader is familiar with TDM systems of transmitting information from keyboards and stops of an organ, to the pipe chamber of the organ. Such a system is described in my British patent specification No. 1516646.

Having regard to the general description given hereinbefore, the operation and arrangement of keyboard couplers at a console of an organ of the present invention will now be described.

A coupler scanner, 1, consisting of a binary divider chain of, typically, 5 binary stages providing a divide-by-32 function is driven by a clock 2 at a rate which delivers pulses to a channel counter 3 at a suitable channel rate, typically 40–80 μs per channel, and scans the desired number of couplers 4 (up to a maximum of 32) via a coupler selector 5. The coupler scanner 1 also provides corresponding address lines 6 to a read-only-memory 7 which has been programmed to furnish the necessary data for the desired couplers.

The ROM 7 furnishes an 8-bit word for each coupler 4. Three of the 8 bits address a keyboard selector 8 to determine which of eight possible keyboards (not shown) shall furnish the signal which, combined with other signals, will control a modulator 9 which provides the output signal from the console. At the same time, three other bits from the ROM 7 are combined with three address bits from the channel counter 3 which specify which keyboard is currently regarded as the "home" keyboard for channel-scanning purposes. This combination is effected in three exclusive-OR gates 10 whose outputs are combined in a gate 11 so that the output of gate 11 shows whether the "home" keyboard nominally being scanned corresponds with that specified by the ROM 7 as the keyboard to which coupling is desired.

The remaining two bits of the 8-bit word supplied by ROM 7 are used to specify the pitch at which coupling is to occur, and are fed to a pitch decoder 12. Conventionally, only three different pitches are required, namely unison, octave and suboctave, but the two bits supplied to the decoder 12 provide four possible combinations and a spare combination is therefore available to specify a non-standard pitch if desired, for example a quint.

The pitch decoder 12 provides simple logic to translate the two-bit code into a binary number injected into a binary adder 13 for the purpose of modifying the address at which keyboard notes are selected by the channel counter 3 in accordance with the required change of pitch. The outputs of the adder 13 supply addresses to all of the keyboard multiplexers 14, each of which can serve up to 64 channels, that is to say, sufficient for standard keyboards of 61 notes.

The keyboard note address is supplied from the channel counter 3 by way of six lines 15, to the binary adder 13 and after modification therein, is supplied to address lines 16 of the keyboard multiplexers 14 by way of six lines 17. With three bits from the ROM 7 used for addressing the keyboard selector 8, there will be a maximum of eight keyboard multiplexers 14 and eight keyboards. A note contact of one keyboard is indicated by reference numeral 18.

The outputs of the coupler selector 5, the keyboard selector 8 and the gate 11 are combined by a strobed gate 19 so that if, and only if, all three signals are simultaneously affirmative, a latch 20 is set by way of line 21 and supplies a signal to the modulator 9 indicating that the channel is to be regarded as ON. The latch 20 is reset by way of a line 22 from the scanner 1 at the commencement of each coupler scan, that is to say, for each channel. Details of the latch 20 and modulator 9 are not given herein because they depend on the form of modulation used, which does not form part of this invention. It is necessary to take account of the transient nature of the signal from gate 19 and, depending on the method of modulation, it may be necessary to carry out the coupler/note correlation one step in advance in the TDM transmission, and to transfer the result of that correlation to a temporary store which is read for controlling the TDM transmission while the next sequence of coupler correlation is taking place.

It is common practice to provide "unison off" controls on some keyboards. Such controls are merely unison couplers operating in an inverted mode and can readily be embodied in organs of the present invention. However, it should be noted that when "unison off" controls are NOT provided the effect is that of a coupler permanently on, and in the present invention appropriate words must be provided in the ROM 7 and the relevant coupler selector input must be permanently wired ON instead of being connected to a control switch.

The adder 13 should preferably include circuitry (not shown) to blank out couplings which would result in overflow beyond the ends of the keyboards. It should be noted that when the pitch requirements demand a subtraction in place of an addition this can be by adding a binary complement (as is well-known) provided that overflow criteria are properly engineered.

Figure 1:
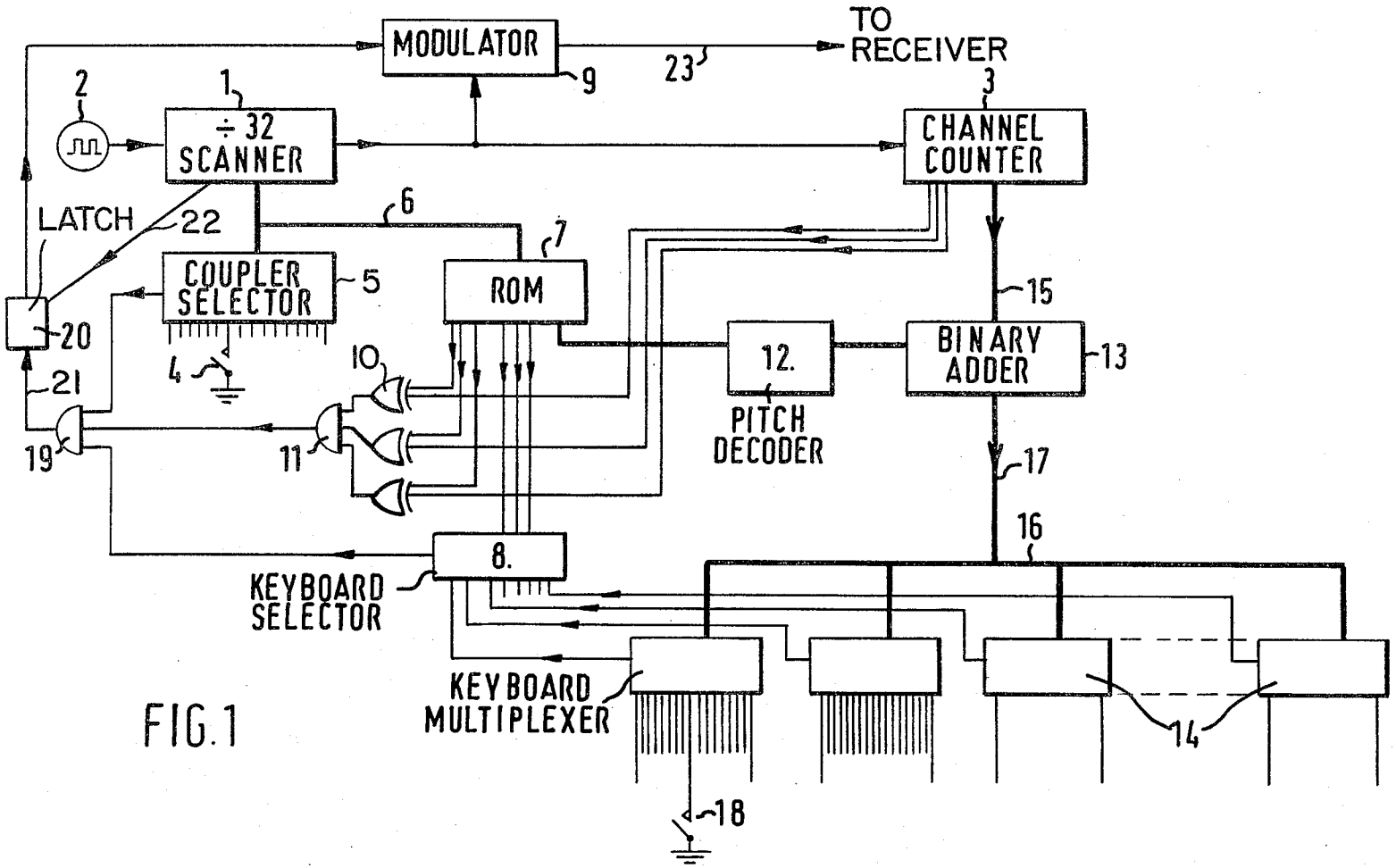
FIG. 1 is a block diagram of a circuit arrangement provided at the console of an organ of the invention.
Figure 2:
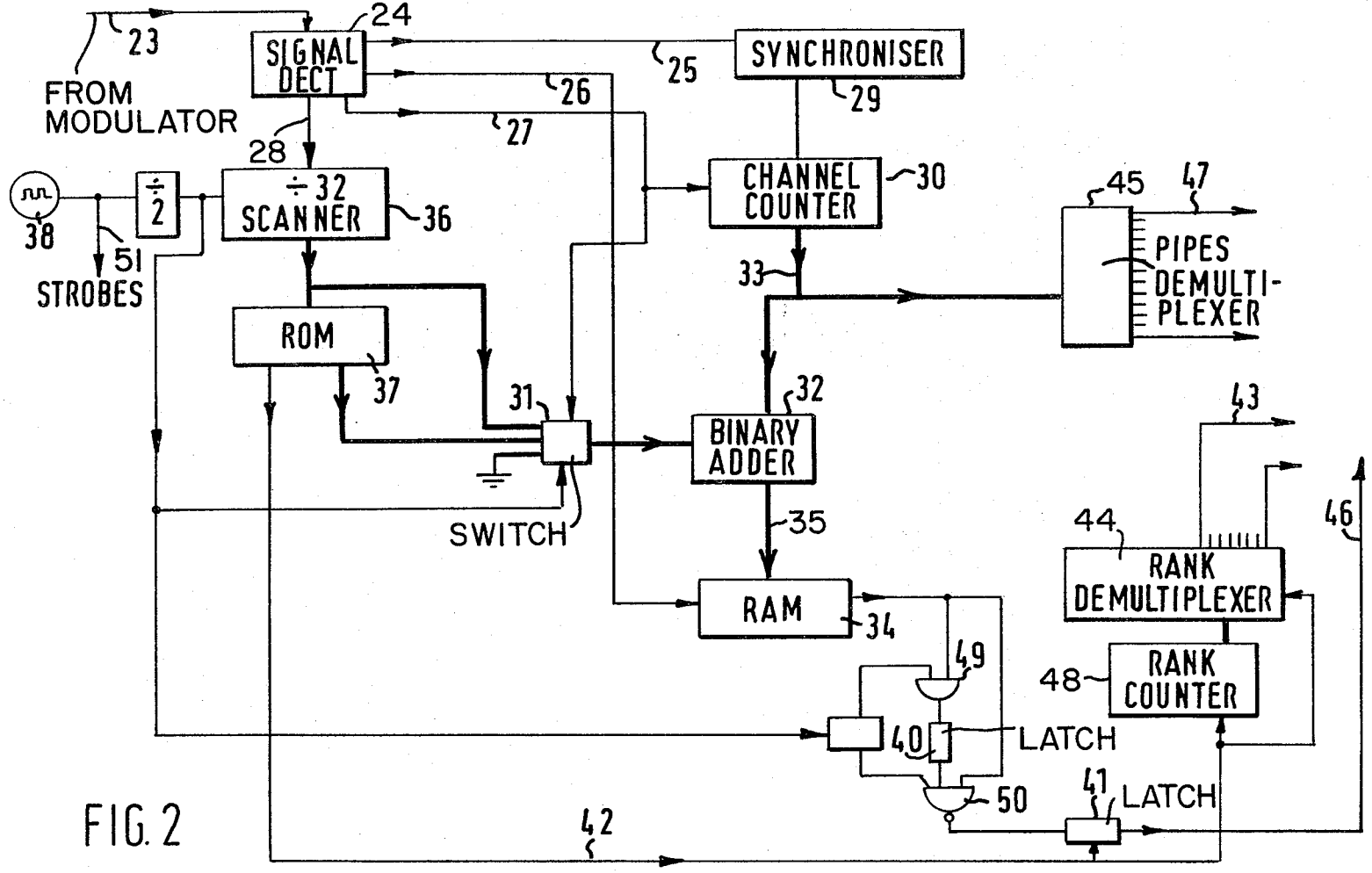
FIG. 2 is a block diagram of a circuit arrangement provided at the pipe chamber of an organ of the invention.

The output signal from the modulator 9 of FIG. 1 is fed by way of a line 23 to a receiver located in the pipe chamber, and the receiver will now be described with reference to FIG. 2.

The incoming signal on line 23 from the organ console is processed by a signal detector 24, to generate a synchronising signal on an output line 25, a data signal on an output line 26, a stepping signal on an output line 27 and a scanner reset signal on an output line 28.

The synchronising signal on line 25 is fed to a synchroniser 29 which controls a channel counter 30 so as to keep it in synchronism with the channel counter 3 of FIG. 1. The stepping signal on line 27 is fed to the channel counter 30 to cause stepping thereof and is also fed to an electronic switch 31 which controls a binary adder 32. The data signal on line 26 is fed to a random-access memory (RAM) 34 and the reset signal on line 28 is fed to a divide-by-32 (or 64) scanner 36 provided for scanning a read-only-memory (ROM) 37.

The binary adder 32 is interposed between the binary outputs of the channel counter 30 on address lines 33 and the binary address inputs of the RAM 34 on address lines 35. During the writing of incoming data into RAM 34 the switch 31 ensures zero addition so that data is recorded at the correct memory address.

During the period allotted to each channel (about 40 to 80 $\mu$S, depending upon size of instrument and scanning rate) the ROM scanner 36 is driven by a clock 38, at a rate sufficient to scan all the stops in the available time. The rate is made somewhat higher than necessary and provision is made to blank out any overscan. The ROM 37 is pre-programmed to furnish the required pitch, keyboard, and rank information for each stop. For each stop, the switch 31 first selects an address in the RAM 34 at which the state of the organ stop is recorded and if the stop is ON a latch 40 is set. Switch 31 then causes the adder 32 to combine the pitch and keyboard data from the ROM 37 with the current channel address from the counter 30 to interrogate the RAM 34 for the state of the relevant keyboard note. If both of these interrogations give an affirmative result a latch 41 is set.

As all stops relating to any one rank are dealt with in one uninterrupted sequence, latch 41 is set if any one or more of the relevant stop/note combinations so requires. At the end of each rank sequence, the ROM 37 furnishes a signal on a line 42 which sends an enable pulse to the relevant rank enable line 43 via the rank de-multiplexer 44, the correct pipe having already been selected by the pipe de-multiplexer 45, which is driven by the same binary counter 30, that controls the RAM address, modified by the adder 32. The enable pulse sets the pipe magnet control latch in accordance with the data furnished by latch 41 on a data line 46 which is common to all ranks.

The rank de-multiplexer 44 has as its outputs one enable line 43 for each rank. The pipes de-multiplexer 45 has as its outputs a plurality of lines 47 (there being a maximum of 128 lines for the configuration described above), there being one line 47 for all corresponding pipes of every rank.

Thus, the lines 47 determine which pipes in each rank can be enabled, the lines 43 determine which ranks can be enabled, and the line 46 supplies actuating data for the relevant pipe magnet control latch at the appropriate time.

The preferred arrangement of pipe latches and rank latches is shown in FIG. 3. In that schematic drawing, pipes 54 are arranged in vertical ranks. Only two ranks of pipes are shown which, for example, may be a flute rank and a French horn rank. In an ordinary organ there are, of course, more than two ranks of pipes. Actuation of each pipe is controlled by its own control mechanism 55 which may, for example, be an electromagnetic device. The mechanism 55, in turn, is controlled by the output of its own pipe latch 56. All pipe latches in a rank have their inputs connected in common to a rank latch 57 which obtains its input from a line 43 of rank demultiplexer 44. In addition, each pipe latch in every rank has another input connected, as indicated by line 46, to the output of latch 41. Pipes in each rank which correspond in pitch have the clock terminals of their pipe latches connected in common as indicated by horizontal lines 47 in FIG. 3. That arrangement causes all pipe latches for pipes of corresponding pitch of all the ranks to be enabled simultaneously.

On cessation of the enable pulse on line 42, the latch 41 is reset and rank counter 48 is advanced one step in readiness to deal with the next rank.

FIG. 4 shows a modification of the arrangement schematically depicted in FIG. 3. In the modified arrangement, a master latch 60 replaces the individual rank latches 57 employed in the FIG. 3 arrangement. In the FIG. 4 modification, all the pipe latches 56 of a given rank are enabled by a common enabling signal transmitted to that rank over one of the lines designated 43. The appropriate rank line 43 is selected by a simple demultiplexer driven by the rank counter 48 (FIG. 2).

Provision is made for the following matters which, for the sake of clarity of the main functions, have not been shown in the drawings:

Gates 49 and 50 controlling latches 40 and 41 are strobed from the clock 38 by way of a strobe line 51. The circuits of the adder 32 and of the switch 31 contain logic to prevent overflow from addresses above or below range into areas proper to adjacent keyboards. The adder 32 and the switch 31 also disconnect the address lines 33 from channel counter 30 during interrogation of the RAM 34 in respect of the stops, for which the full addresses are supplied by the ROM 37 and the switch 31. The rank counter 48 is reset to the first rank at the same time as the scanner 36 is reset.

Although this description has been given in respect of a pipe organ and although the only sound producing devices described have been organ pipes, it will be understood that the invention resides in the control arrangement itself, and that instead of organ pipes, other sound producing devices capable of being electrically switched between on and off conditions can be used. Accordingly, the term "organ pipes" used herein should be interpreted as covering electrically switchable discrete pitch sound producing devices generally.

Modifications are possible, for example a further modification, for large instruments, uses two independent RAMs, one for stops and one for notes, thus allowing simultaneous interrogation and immediate correlation (instead of in two steps) and doubling of the number of stops which can be dealt with in the available time between channels. The numbers of stops and notes can of course be increased almost without limit by replication of appropriate parts of the circuitry.

I claim:

1. A pipe organ comprising:

a pipe sounding section having ranks of pipes for sounding musical notes;

a note playing section having a plurality of playing keys allocated to individual notes and operable by a player of the organ;

a plurality of stops operable by the player of the organ for selecting correlations between keys played and pipes to be sounded, said stops selecting various pitch relationships between the keyboard and the pipes;

a receiving section;

means for deriving and transmitting electric signals providing information relative to the operative conditions of the stops and keys to said receiving section;

said receiving section comprising binary logic means arranged for addressing pipes and ranks in a predetermined sequence and arranged for examining the said transmitted signals, whereby to derive pipe and rank enable signals if for the particular pipe or rank address the said operative conditions of the stops and keys require the pipe or pipes to be sounded;

said receiving section having a programmed read-only memory (ROM) holding specifications for the rank coupling to be effected to meet the requirements of given stops;

a time division multiplex system for transmission of the signals to the receiving section;

a random access memory (RAM) in said receiving section providing temporary storage of data corresponding to the transmitted signals;

means for examining the RAM status while performing the pipe and rank address sequencing in order to derive the pipe and rank enable signals;

electromagnetic devices for controlling sounding of the pipes;

a pipe latch for energising the controlling device of each pipe, each pipe latch having a data input terminal for receiving signals indicative of whether the pipe is required to be sounded, a data output terminal for transferring the data requirement to the controlling device of the pipe, and an enable clock input terminal for receiving a clock signal, the pipe latch changing its state, if the data input signals specifies a change of state, only when the clock signal is received;

means connecting together the data input terminals of the pipe latches of any one rank to form a common data input line for that rank;

the clock input terminals of the pipe latches for pipes of corresponding pitch of all ranks being connected in common whereby an array is formed of clock lines each of which clocks all of the pipe latches of a given pipe pitch;

a de-multiplexing system arranged to connect the said clock lines one at a time to a master clocking line;

a binary counter forming part of said binary logic means, by which the de-multiplexing system is addressed, the counter operating at a rate permitting examination of all of the stops requirements during a time period allocated for the processing of signal data relevant to each pipe;

means for interrogating the RAM to determine the current state of a stop;

a binary adder having one set of inputs to which the address of the pipes as represented by the current state of the said de-multiplexing system is connected; and means for feeding to another set of inputs of the adder, binary signals from the ROM which define the number of semitones difference between pipe pitch corresponding to the current state of said de-multiplexing system and the note pitch required whereby the output of the adder defines the address within a keyboard of a key which would sound the pipes of any rank at the pipe and stop addresses currently under examination.

2. The pipe organ according to claim 1, wherein the RAM is arranged in at least two sections, one section serving for storage of data relevant to the notes of the keyboards and another section serving for storage of data relevant to the stops, and further comprising means for reading out the data from the said two RAM sections simultaneously.

3. The pipe organ according to claim 1 and further comprising means for deriving information from the ROM as to which home keyboard is to be selected as relevant to a required stop, said means using this information together with the output of said adder to define an address at which the RAM containing the record of keyboard notes is interrogated.

4. The pipe organ according to claim 3 and further comprising means whereby when said interrogation of the RAM shows that the relevant stop is "on", and when interrogation of the RAM shows that the relevant keyboard note is "on", a rank latch serving the pipe rank specified by said relevant stop is enabled, the outputs of said rank latches supplying the data lines of the pipe latches of said specified rank.

5. A pipe organ comprising:

a pipe sounding section having ranks of pipes for sounding musical notes;

a note playing section having a plurality of playing keys allocated to individual notes and operable by a player of the organ;

a plurality of stops operable by the player of the organ for selecting correlations between keys played and pipes to be sounded, said stops selecting various pitch relationships between the keyboard and the pipes;

a receiving section;

means for deriving and transmitting electric signals providing information relative to the operative conditions of the stops and keys to said receiving section;

a time division multiplex system for transmission of the aforesaid electrical signals to the receiving section;

said receiving section comprising binary logic means arranged for addressing pipes and ranks in a predetermined sequence and arranged for examining the said transmitted signals, whereby to derive pipe and rank enable signals if for the particular pipe or rank address the said operative conditions of the stops and keys require the pipe or pipes to be sounded;

said receiving section having a programmed read-only memory (ROM) holding sepcifications for the rank coupling to be effected to meet the requirements of given stops, the ROM providing one bit of its output as a marker indicating when the last stop relative to a rank has been reached;

a random access memory (RAM) in said receiving section providing temporary storage of data corresponding to the transmitted signals;

means for examining the RAM status while performing the pipe and rank address sequencing in order to derive the pipe and rank enable signals;

electromagnetic devices for controlling sounding of the pipes;

a master latch having an input for receiving rank data signals from the ROM, the master latch having its output connected in common to the ranks of pipes each rank of pipes having its own enable line which controls that rank of pipes;

sequencing means responsive to the marker bit of the ROM output for enabling the individual ranks in sequence; and means for controlling the pipe controlling devices jointly through said master latch and said sequencing means.

6. The pipe organ according to claim 5 and further comprising, (a) a separate enable line for controlling each rank, and (b) means for pulsing the enable line of a given rank when all of the stops of a given rank have been dealt with.

7. The pipe organ according to claim 6, wherein the sequencing means comprises (i) a de-multiplexer for selection of the rank enable line, and (ii) a rank counter which is stepped forward by said marker bit, the rank counter driving the de-multiplexer.

8. The pipe organ according to claim 5 and further comprising pipe latches for energising said devices for controlling sounding of the pipes, each of those devices having its own pipe latch, and the pipe latches being included in said means for controlling the pipe controlling devices jointly through said master latch and said sequencing means.

* * * * *